US006254390B1

(12) United States Patent
Wagner

(10) Patent No.: US 6,254,390 B1
(45) Date of Patent: Jul. 3, 2001

(54) ORAL BURNISHER

(76) Inventor: Eugene C. Wagner, 1626 Chastain Pkwy. E., Pacific Palisades, CA (US) 90272

( * ) Notice: Subject to any disclaimer, the term of this patent is extended or adjusted under 35 U.S.C. 154(b) by 0 days.

(21) Appl. No.: 09/480,242

(22) Filed: Jan. 10, 2000

(51) Int. Cl.[7] ..... A61C 15/00
(52) U.S. Cl. ..... 433/216; 15/110; 15/167.2
(58) Field of Search ..... 433/216, 141; 15/110, 167.1, 167.2; 132/308, 310

(56) References Cited

U.S. PATENT DOCUMENTS

| | | | | |
|---|---|---|---|---|
| D. 110,936 | | 8/1938 | Wiseman . | |
| D. 273,153 | | 3/1984 | Wagner | D4/28 |
| D. 315,450 | | 3/1991 | Wagner | D4/106 |
| 774,253 | | 11/1904 | Keefe . | |
| 1,687,079 | * | 10/1928 | Barker | 15/110 |
| 1,833,555 | | 11/1931 | Bell . | |
| 1,840,484 | | 1/1932 | Brown . | |
| 2,771,624 | * | 11/1956 | Ripper | 15/167.2 |
| 3,660,902 | | 5/1972 | Axelsson . | |
| 5,032,082 | | 7/1991 | Herrera | 433/141 |
| 5,040,260 | | 8/1991 | Michaels | 15/167.1 |
| 5,284,168 | * | 2/1994 | Klinkhammer | 132/308 |
| 5,930,860 | * | 8/1999 | Shipp | 15/110 |

* cited by examiner

*Primary Examiner*—John J. Wilson
*Assistant Examiner*—Melba Bumgarner
(74) *Attorney, Agent, or Firm*—Natter & Natter

(57) ABSTRACT

An oral burnisher includes a "U" shaped head at one end of the handle. The head includes a pair of substantially parallel side panels and a back panel covered by a thermoplastic elastomer sheath. The side panels include inwardly facing arrays of thermoplastic elastomer projections which extend from the sheath and the back panel includes an array of thermoplastic elastomer projections which extend from the sheath on its inner face. The outer face of the back panel is also provided with an array of thermoplastic elastomer projections which extend from the sheath. The thermoplastic elastomer sheath may be molded over the surface of the panels which are formed in one piece with the handle of a suitable plastic such as polypropylene. The projections of each array extend in the order of 1–2 mm. and have generally hemispherical tips such that the transverse dimension of the head is relatively small and can easily be accommodated in the oral cavity.

14 Claims, 2 Drawing Sheets

ORAL BURNISHER

BACKGROUND OF THE INVENTION

1. Field of the Invention

This invention relates generally to oral hygiene appliances and more particularly to an appliance for simultaneously cleaning and/or burnishing multiple tooth surfaces.

2. Antecedents of the Invention

Personal oral hygiene has been a challenge throughout the ages and into the new millennium. Various toothbrush structures have been suggested for simplifying tooth brushing procedures by simultaneously cleaning multiple tooth surfaces. Typical examples are illustrated in U.S. Pat. No. Des. 273,153 and U.S. Pat. No. Des. 315,450 both issued to Applicant herein.

Employment of Applicant's prior toothbrushes provided multiple cleansing surfaces for simultaneous contact with labial, lingual and occlusal tooth surfaces. As a result, the brushing procedure was greatly simplified and reduced to longitudinal reciprocal motion. As such, it was particularly well-suited for use by children and young adults.

Unfortunately, the head configuration of prior multiple surface toothbrushes mandated a relatively large lateral extension at the toothbrush head. The lateral dimensions of the toothbrush head constituted a drawback, especially in conjunction with young children.

The beneficial advantages of utilizing a thermoplastic elastomer material for oral hygiene surfaces in contact with teeth have been set forth in U.S. Pat. No. 5,040,264 to MICHAELS, which illustrated a toothbrush head having a plurality of projections of different geometric configuration. While the MICHAELS device may have been effective in cleansing and/or burnishing tooth surfaces, the overall geometric size and toothbrush head configuration appeared to be generally the same as a conventional toothbrush.

A need exists, therefore, especially in connection with promoting oral hygiene in young children, to simplify tooth brushing procedures while effectively cleansing and polishing tooth surfaces.

SUMMARY OF THE INVENTION

An oral burnisher includes an elongate handle having a head at one end. The head is configured as a trough of "U" shaped transverse cross section. The head includes a pair of opposed side panels and an inner back panel. Each side panel includes an inwardly facing array of thermoplastic elastomer projections while the inner back panel includes a similar array of thermoplastic elastomer projections. The outer face of the back panel is also provided with an array of thermoplastic elastomer projections for tooth cleansing and/or burnishing.

In use, the burnisher head is placed over the user's teeth such that the projections of one side panel engage labial tooth surfaces, the projections of the opposite side panel engage lingual tooth surfaces and the projections extending from the inner back panel engage occlusal tooth surfaces.

The handle is grasped and the burnisher is moved in a reciprocal motion with the projections engaging the tooth surfaces in rubbing contact to cleanse and burnish the tooth surfaces.

Front tooth surfaces may be optionally burnished utilizing the array of thermoplastic elastomer projection which extend from the outer face of the back panel.

The thermoplastic elastomer projections may be molded over the surface of the head, which may be formed in one piece with the handle of a more rigid plastic, such as polypropylene.

From the foregoing compendium, it will be appreciated that it is an aspect of the present invention to provide an oral burnisher of the general character described which is not subject to the disadvantages of the antecedents of the invention aforementioned.

A feature of the present invention is to provide an oral burnisher of the general character described which is easy to use.

It is a consideration of the present invention to provide an oral burnisher of the general character described having multiple engagement surfaces for simultaneous contact with multiple tooth surfaces.

A further aspect of the present invention is to provide an oral burnisher of the general character described which is relatively low in cost.

Another consideration of the present invention is to provide an oral burnisher of the general character described which is well adapted to economical mass production fabrication.

A further feature of the present invention is to provide an oral burnisher of the general character described which is well suited for usage by both adults and children.

Yet another consideration of the present invention is to provide an oral burnisher of the general character described which is capable of simultaneously burnishing multiple tooth surfaces with a thermoplastic elastomer.

To provide an oral burnisher of the general character described which induces children to practice oral hygiene is a still further feature of the present invention.

A still further aspect of the present invention is to provide an oral burnisher of the general character described having a head dimensioned for comfortable usage.

Yet another consideration of the present invention is to provide an oral burnisher of the general character described which is equally suited for use with our without a dentifrice preparation.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations and certain other aspects, features and considerations are hereinafter attained, or with reference to the accompanying drawings and the scope of which will be more particularly pointed out and indicated in the appended claims.

BRIEF DESCRIPTION OF THE DRAWINGS

In the accompanying drawings in which is shown one of the various possible embodiments of the invention.

DESCRIPTION OF THE PREFERRED EMBODIMENT

Figure 1:
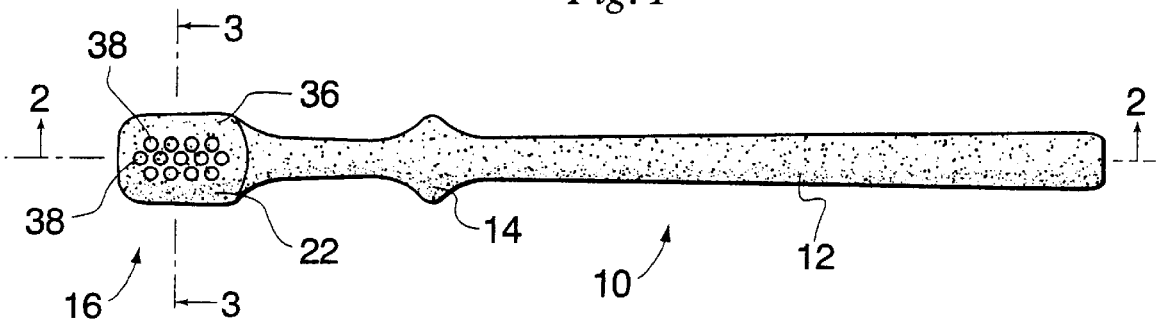
FIG. 1 is a top plan view of an oral burnisher constructed in accordance with and embodying the invention and having an elongate handle and a head formed at one end, with the head having a plurality of projections.
Figure 2:
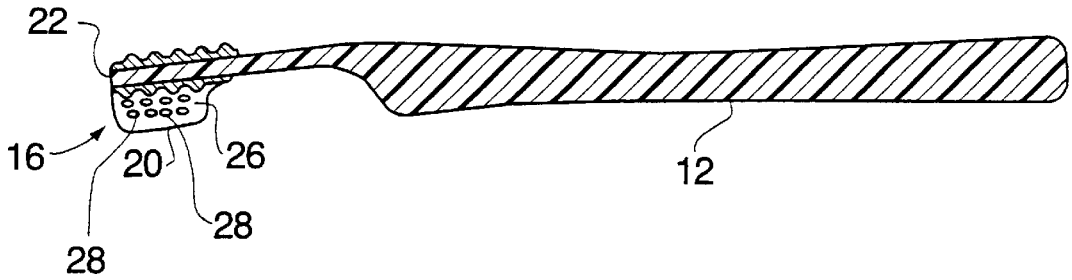
FIG. 2 is a longitudinal cross sectional view through the oral burnisher and illustrating projections formed on an inner face of a side panel of the head and on both inner and outer faces of a back panel of the head.
Figure 3:
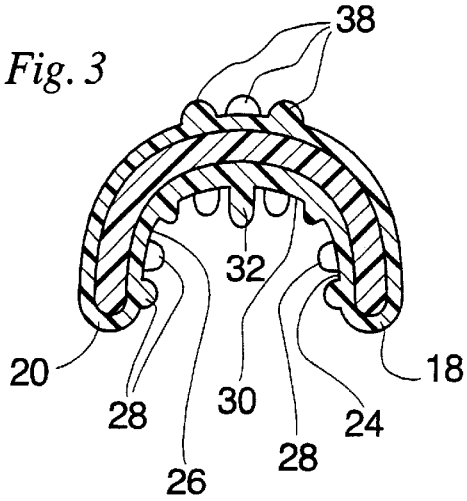
FIG. 3 is an enlarged cross sectional view through the head, the same being taken substantially along the plane 3—3 of FIG. 1.

Referring now in detail to the drawings, the reference numeral 10 denotes generally an oral burnisher constructed in accordance with and embodying the invention. The oral burnisher 10 includes an elongate handle 12 configured with a hand grip thumb rest 14 in a manner substantially identical to that shown in U.S. Pat. No. Des. 315,450 incorporated herein by reference. It should be understood, however, that the particular configuration of the handle does not constitute a significant aspect of the present invention.

In accordance with the invention, at one end of the handle 12 is a head 16. The head 16 is shaped generally as a trough of substantially "U" shaped transverse cross section and includes a pair of substantially parallel side panels 18, 20. The side panels are joined by a back panel 22.

An inner face 24 of the side panel 18 and an inner face 26 of the side panel 20 is formed with an array of projections 28 formed of a thermoplastic elastomer material which has properties similar to rubber. Suitable thermoplastic elastomers for implementation in the present invention include thermoplastic elastomers disclosed in U.S. Pat. No. 5,040,260, incorporated herein by reference, and DYNAFLEX thermoplastic rubbers, e.g. DYNAFLEX G-2740, available from GLS Corporation of Arlington Heights, Illinois.

The side panel projections 28 may be of any efficacious configuration. They are preferably cylindrical at their base and hemispherical at their tips and extend from the side panel 18, 20 a distance in the order of one to two millimeters.

An inner face 30 of the back panel 22 also includes an array of thermoplastic elastomer projections 32 which are similar in shape to the projections 28 but preferably extend from the face 30 a greater distance than the distance the projections 28 extend from their respective faces 24, 26, e.g. up to between two and two and one-half times.

The oral burnisher 10 may be fabricated by initially molding the handle 12 and the side and back panels of the head 16 in one piece of a suitable thermoplastic such as polypropylene and thereafter molding a covering sheath or layer 34 of thermoplastic elastomer completely around the side and back panels of the head 16 with the arrays of projections being formed of one piece with the sheath 34.

It should also be noted that an outer face 36 of the back panel 22 includes a similar array of projections 38, also formed of one piece with the sheath 34.

Figure 4:
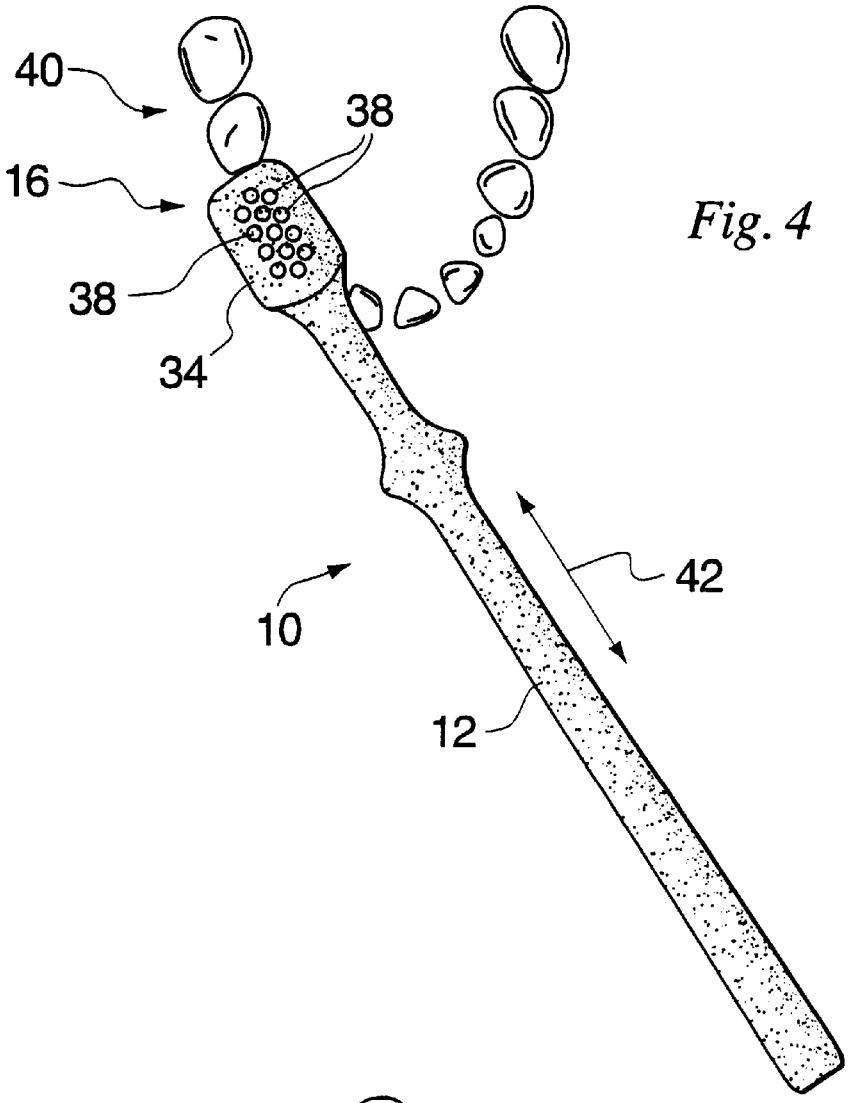
FIG. 4 is a top plan diagrammatic view of the oral burnisher in use for simultaneously cleansing and burnishing multiple surfaces of a lower jaw with teeth of a juvenile mandible shown for illustrative purposes.

With attention now directed to FIG. 4, it will be seen that in use, the head 16 is placed over a plurality of teeth 40 of a juvenile mandible, for example, such that the side panels 18, 20 completely cover the labial and lingual surfaces of the teeth. The length of the head is such that at least two adjacent teeth will be covered. In such position, the side panel projections 28 and the projections 32 of the inner face of the back panel are in contact with the respective tooth surfaces. Dentifrice may be employed by being placed within the head prior to placement of the trough in the mouth or the burnisher may be utilized without dentifrice. Thereafter, the oral burnisher is then moved in a reciprocal back and forth direction as indicated by an arrow 42 of FIG. 4.

Figure 5:
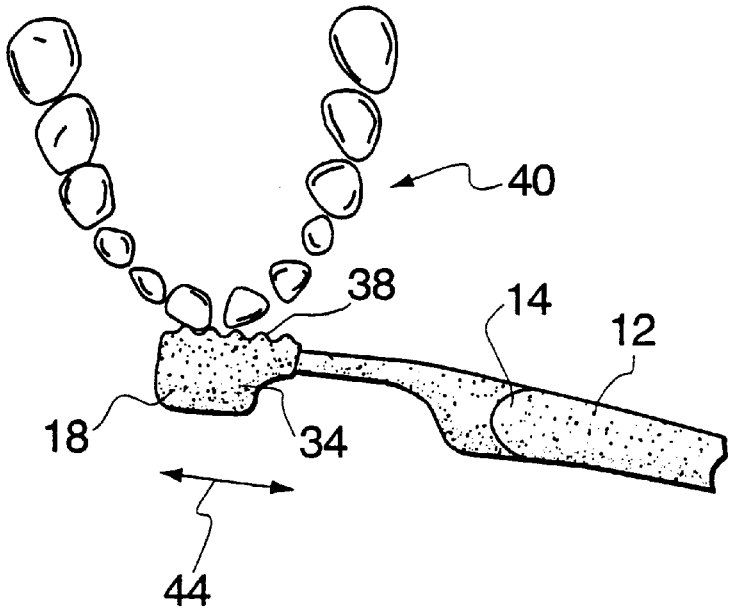
FIG. 5 is a top plan view illustrating the oral burnisher in use for cleansing and burnishing labial front tooth surfaces and with the projections extending from the external panel of the back of the head.

Referring now to FIG. 5, it should be noted that labial surfaces of front teeth may also be burnished and cleansed utilizing the projections 38 which extend from the outer face of the back panel with the burnisher 10 being moved in a reciprocal direction indicated by an arrow 44.

Oral burnishers 10 may be provided in different sizes to accommodate children and adults.

It should also be appreciated that a combination of conventional bristles and thermoplastic elastomer projections may be employed. For example, the projections 38 of the outer face of the back panel may comprise bristles or the projections 28 on one or both faces of the side panels may comprise bristles or the projections 30 may comprise bristles such that a combination cleansing action of both bristles and thermoplastic elastomer projections will result.

Further, the invention is well adapted for implementation in an electric toothbrush, for example. In such instance the head 16 would include a short handle portion with a connecting adaptor for mounting in a socket of the electric toothbrush handle.

Thus it will be seen that there is provided an oral burnisher which achieves the various aspects, features and considerations of the present invention and which is well-suited to meet the conditions of practical usage.

As various changes might be made in the oral burnisher above set forth without departing from the spirit of the invention, it is to be understood that all matter herein described or shown in the accompanying drawings is to be interpreted as illustrative and not in a limiting sense.

Having thus described the invention, there is claimed as new and desired to be secured by letters patent:

1. An oral burnisher for simultaneous cleansing of multiple surfaces of teeth, the burnisher comprising a handle and a head at an end of the handle, the head including a pair of opposed side panels, a back panel joining the side panels and a sheath of thermoplastic elastomer permanently fixed to and overlying the side panels and the back panel, the side panels having a pair of opposed inner faces and the back panel having an inner face, the sheath including an array of projections at each inner side panel face and an array of projections at the inner face of the back panel, the projections at the inner side panel faces and the projections at the inner face of the back panel being configured to contact tooth surfaces when the head is placed over and surrounding teeth.

2. An oral burnisher for simultaneous cleansing of multiple surfaces of teeth as constructed in accordance with claim 1 wherein the projections extend from the sheath at side panel faces a distance in the order of 1–2 mm.

3. An oral burnisher for simultaneous cleansing of multiple surfaces of teeth as constructed in accordance with claim 2 wherein the projections extend from the sheath at the inner face of the back panel a distance greater than the distance the projections extend from the sheath at the inner face of the side panels.

4. An oral burnisher for simultaneous cleansing of multiple surfaces of teeth as constructed in accordance with claim 1 wherein the sheath and the projections are formed in one piece construction.

5. An oral burnisher for simultaneous cleansing of multiple surfaces of teeth as constructed in accordance with claim 1 wherein the back panel includes an outer face, the oral burnisher further including a plurality of projections extending from the sheath at the outer face of the back panel.

6. An oral burnisher for simultaneous cleansing of multiple surfaces of teeth as constructed in accordance with claim 1 wherein the side panels are substantially parallel.

7. An oral burnisher for simultaneous cleansing of multiple surfaces of teeth as constructed in accordance with claim 1 wherein the projections include hemispherical tips.

8. An oral burnisher for simultaneous cleansing of labial, lingual and occlusal surfaces of teeth, the burnisher comprising a handle and a head at an end of the handle, the head including a pair of opposed side panels and a back panel joining the side panels, the handle, the side panels and the back panel being formed of unitary one piece construction, a thermoplastic elastomer sheath covering the side panels and the back panel, an array of thermoplastic elastomer projections extending from the sheath at an inner face of each side panel and at an inner face of the back panel, the projections being formed in one piece with the sheath.

9. An oral burnisher for the simultaneous cleansing of labial, lingual and occlusal surfaces of teeth as constructed in accordance with claim 8 wherein the handle, the side panels and the back panel are formed of a thermoplastic material other than a thermoplastic elastomer.

10. An oral burnisher for the simultaneous cleansing of labial, lingual and occlusal surfaces of teeth as constructed in accordance with claim 10 wherein the back panel includes an outer face, the head further including an array of projections extending from the sheath at the outer face of the back panel.

11. An oral burnisher for the simultaneous cleansing of labial, lingual and occlusal surfaces of teeth as constructed in accordance with claim 8 wherein the head comprises a trough having a generally U-shaped transverse cross section.

12. A method of practicing oral hygiene, the method comprising the steps of:

(a) providing an oral burnisher as constructed in accordance with claim 8;

(b) grasping the handle in one's hand;

(c) inserting the head into one's oral cavity;

(d) registering the head over a plurality of adjacent teeth;

(e) moving the head toward the adjacent teeth until the side panels overlie the labial and lingual surfaces of the adjacent teeth with the array of projections extending from the sheath at the side panels in contact with labial and lingual surfaces of the adjacent teeth and the array of projections extending from the sheath at the inner face of the back panel engaging the occlusal surfaces of the adjacent teeth;

(f) moving the oral burnisher in a reciprocal generally axial direction such that multiple surfaces of next successive adjacent teeth are contacted by the projections; and (g) repeating step (f) for a prescribed treatment duration.

13. A method of practicing oral hygiene in accordance with claim 12 further including the step of:

(h) inserting a quantity of dentifrice between the side panels prior to inserting the head into the oral cavity.

14. A method of practicing oral hygiene, the method comprising the steps of:

(a) providing an oral burnisher as constructed in accordance with claim 1;

(b) grasping the handle in one's hand;

(c) inserting the head into one's oral cavity;

(d) registering the head over a plurality of adjacent teeth;

(e) moving the head toward the adjacent teeth until the side panels overlie the labial and lingual surfaces of the adjacent teeth with the array of projections extending from the sheath at the side panels in contact with labial and lingual surfaces of the adjacent teeth and the array of projections extending from the sheath of the inner face of the back panel engaging the occlusal surfaces of the adjacent teeth;

(f) moving the oral burnisher in a reciprocal generally axial direction such that multiple surfaces of next successive adjacent teeth are contacted by the projections; and (g) repeating step (f) for a prescribed treatment duration.

* * * * *